US010847918B2

(12) United States Patent
Tanaka et al.

(10) Patent No.: US 10,847,918 B2
(45) Date of Patent: Nov. 24, 2020

(54) FITTING CONNECTOR

(71) Applicant: Yazaki Corporation, Tokyo (JP)

(72) Inventors: Yasuhiro Tanaka, Shizuoka (JP); Noboru Hayasaka, Shizuoka (JP); Shotaro Shibata, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/671,184

(22) Filed: Nov. 1, 2019

(65) Prior Publication Data

US 2020/0153149 A1 May 14, 2020

(30) Foreign Application Priority Data

Nov. 9, 2018 (JP) ..... 2018-211121

(51) Int. Cl.
*H01R 13/436* (2006.01)
*H01R 13/629* (2006.01)

(52) U.S. Cl.
CPC ... *H01R 13/4365* (2013.01); *H01R 13/62955* (2013.01)

(58) Field of Classification Search
CPC ..... H01R 13/4365; H01R 13/62955; H01R 13/6271; H01R 13/6275; H01R 13/6277; H01R 13/6278
USPC ..... 439/352, 595
See application file for complete search history.

(56) References Cited

U.S. PATENT DOCUMENTS

| | | | | |
|---|---|---|---|---|
| 5,234,356 A * | 8/1993 | Maejima | H01R 13/6272 | 439/352 |
| 5,707,248 A * | 1/1998 | Matsumura | H01R 13/6272 | 439/352 |
| 5,759,058 A * | 6/1998 | Childs | H01R 13/641 | 439/352 |
| 6,261,116 B1 * | 7/2001 | Ceru | H01R 13/6272 | 439/352 |
| 6,447,170 B1 * | 9/2002 | Takahashi | H01R 13/6273 | 385/53 |
| 2018/0226748 A1 | 8/2018 | Hayasaka | | |

FOREIGN PATENT DOCUMENTS

JP 5729248 B2 6/2015

* cited by examiner

*Primary Examiner* — Hien D Vu
(74) *Attorney, Agent, or Firm* — Kenealy Vaidya LLP

(57) ABSTRACT

Provided are a holding structure that holds connectors in a completely fitted state by a first locking holding portion and a second locking holding portion, and an ensuring member. A locking holder includes a locking release operation portion, a cantilever locking arm portion, and a fulcrum portion. A release operation force receiving portion is provided to the ensuring member, and is disposed at such a position that the release operation force receiving portion is not in contact with the fulcrum portion when the locking release operation portion is operated by being pushed while the ensuring member is at the main locking position, and the release operation force receiving portion is in contact with the fulcrum portion when the locking release operation portion is operated by being pushed while the ensuring member is at the temporary locking position.

16 Claims, 12 Drawing Sheets

FITTING CONNECTOR

CROSS-REFERENCE TO RELATED APPLICATION(S)

The present application claims priority to and incorporates by reference the entire contents of Japanese Patent Application No. 2018-211121 filed in Japan on Nov. 9, 2018.

BACKGROUND OF THE INVENTION

1. Field of the Invention

The present invention relates to a fitting connector.

2. Description of the Related Art

Fitting connectors have been known that include two connectors such as a female connector and a male connector to be fitted each other and electrically connect both terminals of the two connectors by completely fitting the two connectors. An example of the fitting connectors includes a holding structure between housings of the respective connectors to hold a fitted state between the connectors in a completely fitted state. The holding structure includes a first locking holding portion provided to one housing and a second locking holding portion provided to the other housing. The first locking holding portion and the second locking holding portion are locked in respective connector removal directions when the first locking holding portion and the second locking holding portion are in the completely fitted state. As a result, the holding structure holds the connectors in the completely fitted state.

The holding structure also includes a locking release function that releases a locked state between the first locking holding portion and the second locking holding portion. The locking release function causes the first locking holding portion and the second locking holding portion in the locked state to be removed from each other in accordance with prescribed locking release operation. For example, the holding structure includes a locking holder provided with the first locking holding portion. The locking holder has the locking release function. The locking holder has the first locking holding portion provided to one end thereof, a locking release operation portion provided to the other end thereof, a cantilever locking arm portion disposed between the first locking holding portion provided to a free end thereof and the locking release operation portion, and a fulcrum portion that causes the locking arm portion to be elastically deformed when the locking release operation portion serving as a point of effort in the locked state is operated by being pushed to cause the first locking holding portion serving as a point of load to be removed from the second locking holding portion. The fatting connector including such a holding structure is disclosed in Japanese Patent No. 529248, for example.

In such a holding structure, it is preferable that the first locking holding portion is not removed from the second locking holding portion even when force in a locking release operation direction is unintentionally applied to the locking release operation portion.

SUMMARY OF THE INVENTION

The present invention aims to provide a fitting connector that can disable unintentional operation of the locking release function.

In order to achieve the above mentioned object, a fitting connector according to one aspect of the present invention includes a first connector that includes a terminal and a housing holding the terminal; a second connector that includes a counterpart terminal and a counterpart housing holding the counterpart terminal, and electrically connects the terminal and the counterpart terminal when a mutual fitted state according to insertion fitting between the housing and the counterpart housing is a completely fitted state; a holding structure that includes a first locking holding portion provided to the housing and a second locking holding portion provided to the counterpart housing, causes the first locking holding portion and the second locking holding portion to be in a lockable state in respective connector removal directions when the fitted state is the completely fitted state, and holds the fitted state in the completely fitted state; and an ensuring member that is assembled to the housing to be capable of relatively moving between a main locking position at which the ensuring member restricts a movement of the first locking holding portion in a removal direction with respect to the second locking holding portion when the fitted state is the completely fitted state and a temporary locking position at which the ensuring member does not restrict the movement of the first locking holding portion in the removal direction with respect to the second locking holding portion when the fitted state is the completely fitted state, wherein the housing includes a locking holder including the first locking holding portion provided at one end of the housing in a connector insertion and removal direction, a locking release operation portion provided at the other end of the housing in the connector insertion and removal direction, a cantilever locking arm portion that is provided with the first locking holding portion at a free end of the cantilever locking arm portion and disposed between the first locking holding portion and the locking release operation portion, and a fulcrum portion that is disposed between the first locking holding portion and the locking release operation portion and applies force on the first locking holding portion serving as a point of load in the removal direction from the second locking holding portion with a contact point with a release operation force receiving portion as a fulcrum when the locking release operation portion serving as a point of effect is operated by being pushed, and the release operation force receiving portion is provided to the ensuring member and disposed at such a position that the release operation force receiving portion is not in contact with the fulcrum portion when the locking release operation portion is operated by being pushed while the ensuring member is at the main locking position, and the release operation force receiving portion is in contact with the fulcrum portion when the locking release operation portion is operated by being pushed while the ensuring member is at the temporary locking position.

According to another aspect of the present invention, in the fitting connector, it is possible to configure that the housing has a space that a portion on the locking release operation portion side of the first locking holding portion of the locking holder enters when the locking release operation portion is operated by being pushed while the ensuring member is at the main locking position.

According to still another aspect of the present invention, in the fitting connector, it is possible to configure that the locking holder includes a locking release arm portion that couples the first locking holding portion and the locking release operation portion, and the fulcrum portion is provided to the locking release arm portion.

According to still another aspect of the present invention, in the fitting connector, it is possible to configure that the ensuring member includes a position restriction portion that locks a side adjacent to the first locking holding portion of the locking holder when the ensuring member is at the main locking position to restrict the movement of the first locking holding portion in the removal direction with respect to the second locking holding portion, an operation portion that is operated when the ensuring member is relatively moved with respect to the housing, and a cantilever position restriction arm portion that is provided to the position restriction portion at a free end of the cantilever position restriction arm portion and disposed between the position restriction portion and the operation portion, and the release operation force receiving portion is provided to the position restriction arm portion.

According to still another aspect of the present invention, in the fitting connector, it is possible to configure that the ensuring member enters the locking release operation portion side of the fulcrum portion of the locking holder in a direction which the locking release operation portion is operated by being pushed when the ensuring member is at the main locking position, and locks the locking release operation portion side of the fulcrum portion of the locking holder when the locking release operation portion is operated by being pushed.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENT

The following describes an embodiment of a fitting connector according to the invention in detail with reference to the accompanying drawings. The embodiment does not limit the invention.

Embodiment

A fitting connector includes two connectors (a first connector and a second connector) to be fitted each other by mutual insertion operation. In the fitting connector, terminals of the respective connectors are fitted each other as a result of the insertion fitting operation, thereby physically and electrically connected. In the fitting connector, the connectors are separated by mutual removal operation, resulting in the physical and electrical connection between the terminals being eliminated. The insertion direction and the removal direction are opposite. In the following description, the insertion direction (fitting direction) of the connector to the counterpart is described as a "connector insertion direction" while the removal direction of the connector from the counterpart is described as a "connector removal direction". When the bidirectional orientations are not specified, the direction is described as a "connector insertion and removal direction". A direction orthogonal to the connector insertion and removal direction is described as a "first orthogonal direction". A direction orthogonal to the connector insertion and removal direction and the first orthogonal direction is described as a "second orthogonal direction".

The fitted state between the connectors is classified roughly into a completely fitted state and a half-fitted state. The completely fitted state is defined as a state where housings of the respective connectors have been inserted up to a designed position and the physical and electrical connection between the terminals of the respective connectors is established. The half-fitted state is defined as a state other than the completely fitted state in a state where the housings of the respective connectors are fitted each other. For example, a fitted state before the completely fitted state in the insertion fitting operation of the respective connectors is the half-fitted state while a fitted state after the completely fitted state is released in the removal operation of the respective connectors is the half-fitted state.

The following describes a fitting connector in the embodiment with reference to FIGS. 1 to 12.

FIGS. 1 to 6 illustrate a first connector 1 and a second connector 2 included in the fitting connector in the embodiment. The fitting connector in the embodiment is a female-male connector having a female connector and a male connector. The first connector 1 is described as the female connector while the second connector 2 is described as the male connector.

Figure 5:
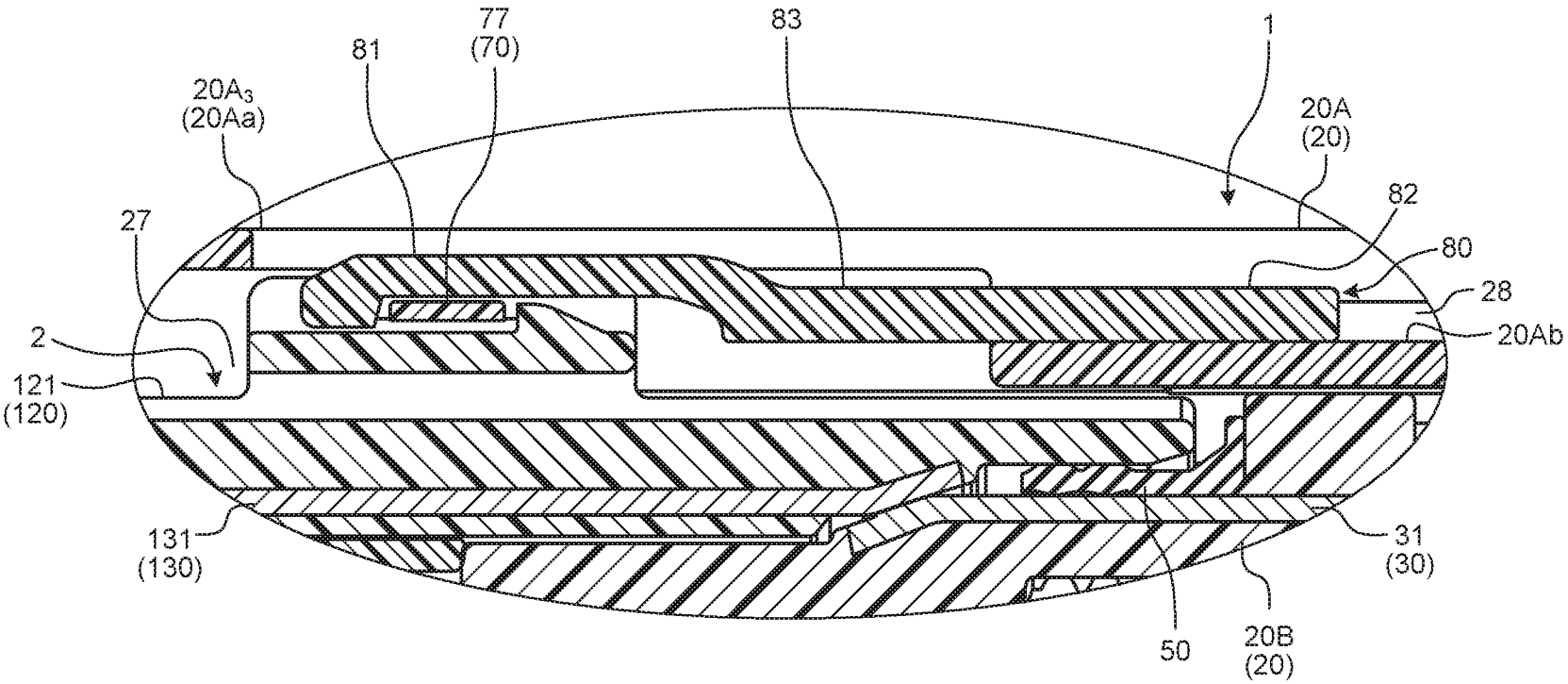
FIG. 5 is a cross-sectional view taken along line X3-X3 in FIG. 2.
Figure 6:
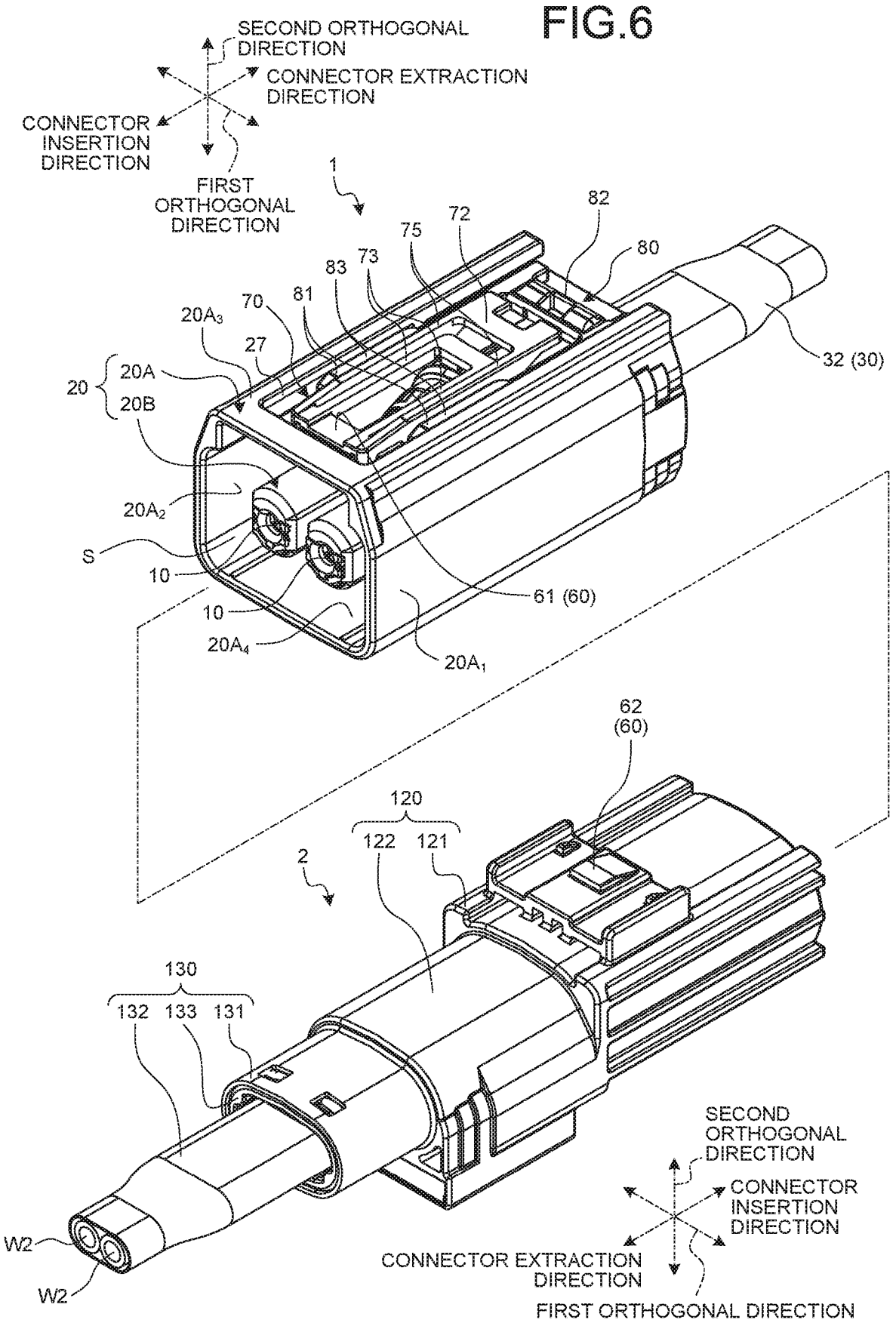
FIG. 6 is a perspective view illustrating a first connector and a second connector before being fitted.
Figure 7:
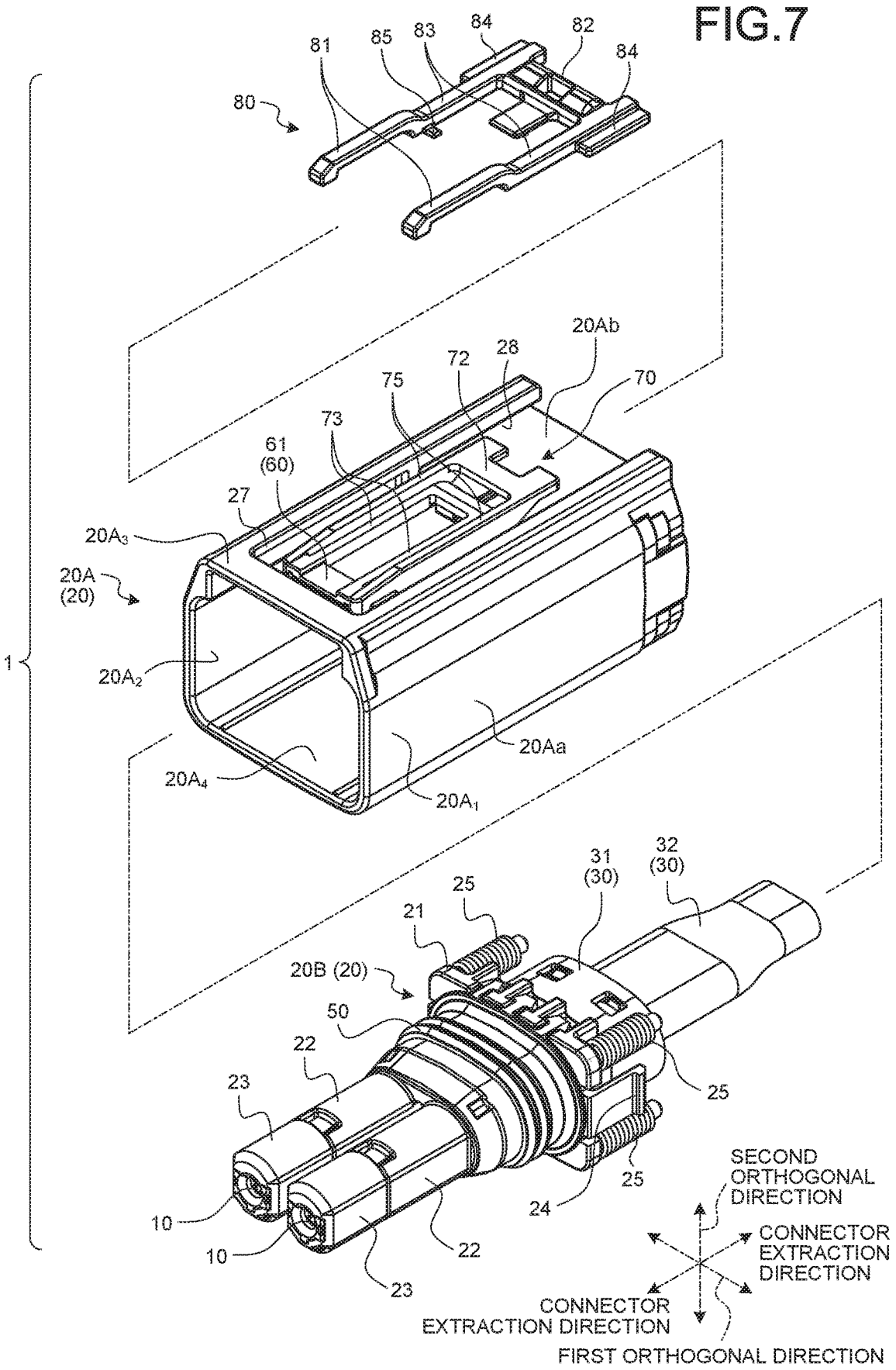
FIG. 7 is an exploded perspective view of the first connector.
Figure 8:
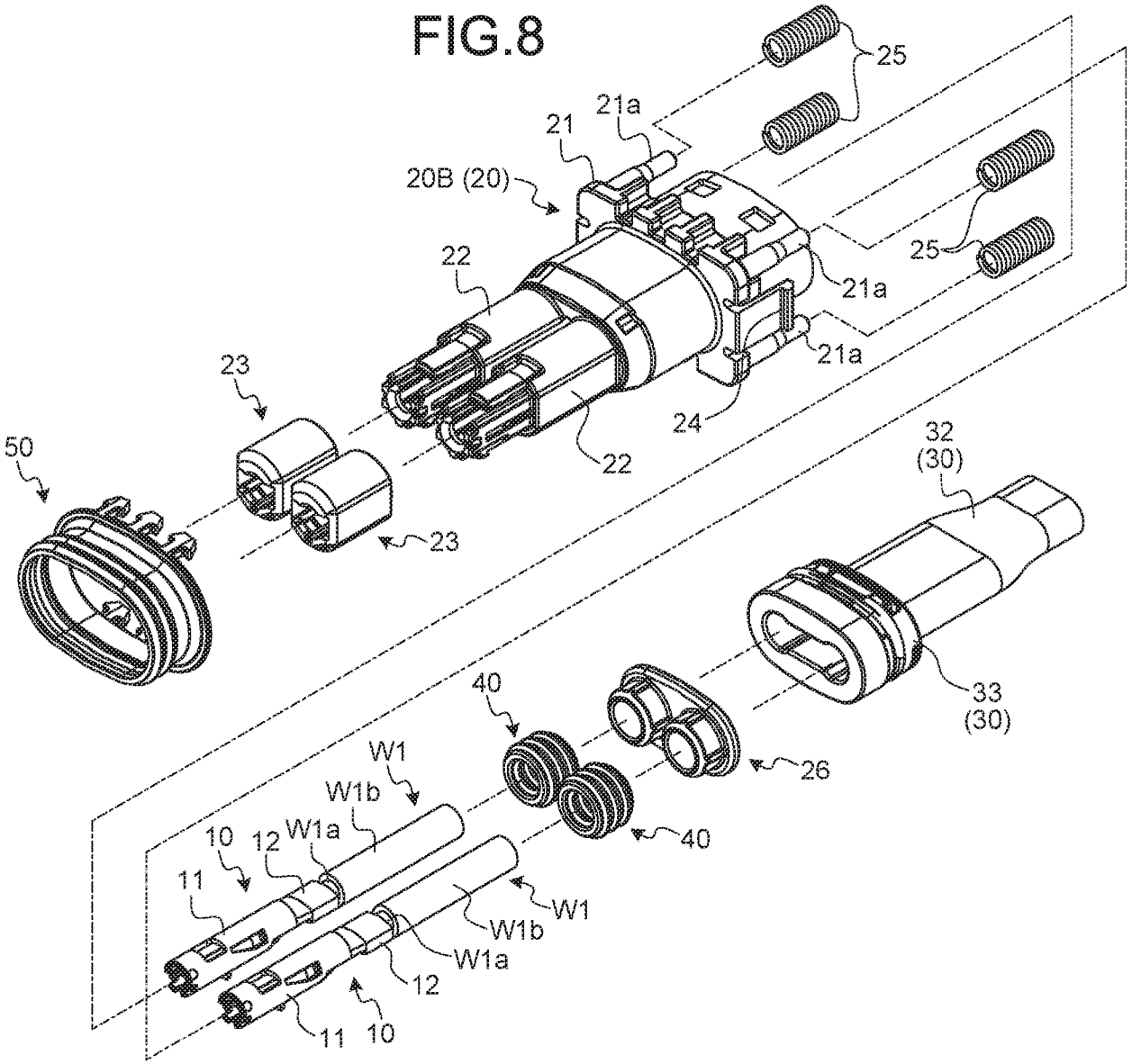
FIG. 8 is an exploded perspective view of internal components of the first connector.
Figure 9:
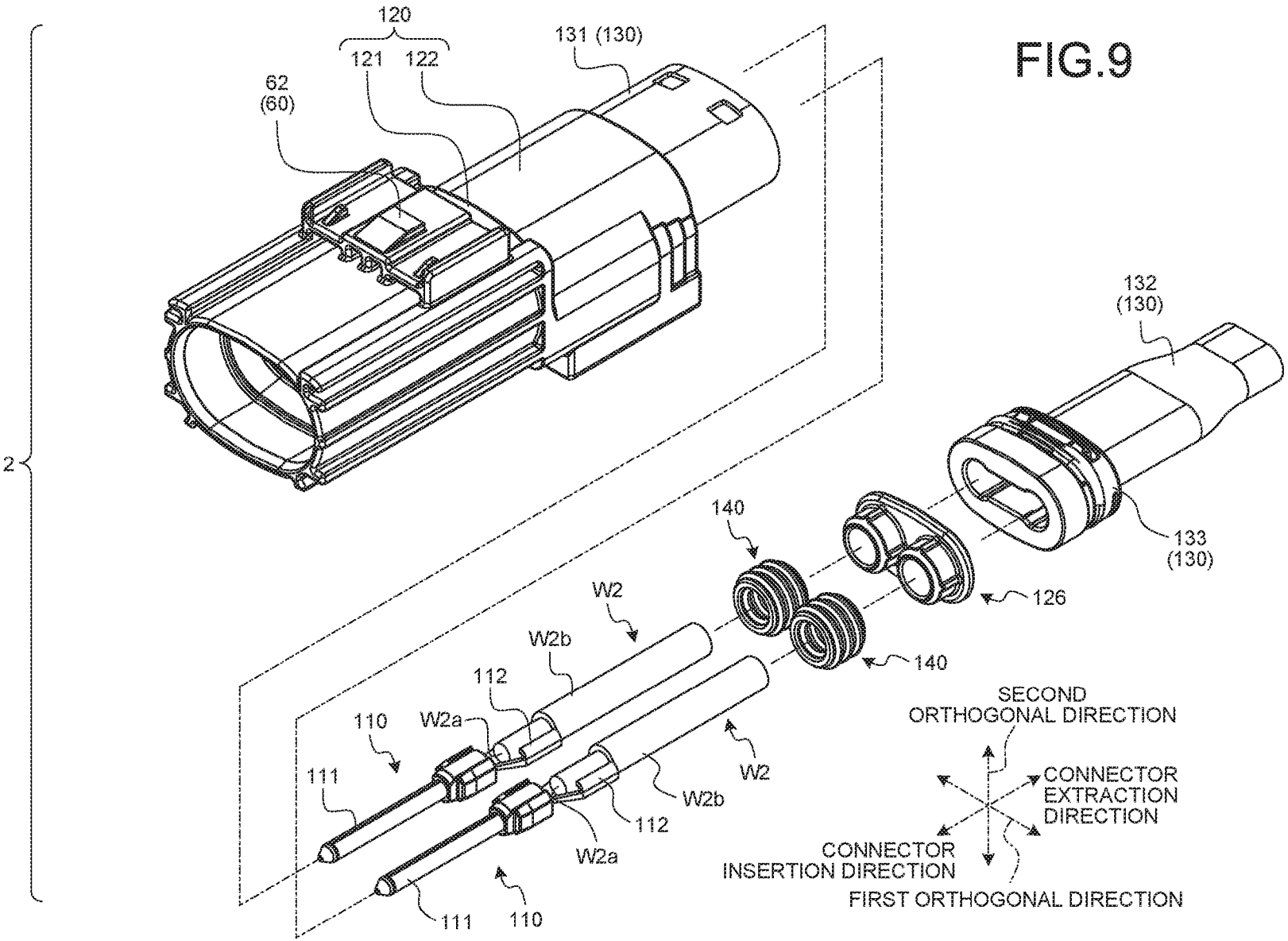
FIG. 9 is an exploded perspective view of the second connector.

The first connector 1 includes terminals (hereinafter described as "female terminals") 10 and a housing (hereinafter described as a "female housing") 20 that holds the female terminals 10 (FIGS. 6 to 8). The first connector 1 further includes a shield structural body 30 (FIGS. 1 to 8) that prevents entering of noise from the outside and sealing members 40 (FIG. 8) that prevent entering of liquid from the outside. The second connector 2 is a counterpart connector fitted in the first connector 1. The second connector 2 includes counterpart terminals (hereinafter described as "male terminals") 110, a counterpart housing (hereinafter described as a "male housing") 120 that holds the male terminals 110, a shield structural body 130 that prevents entering of noise from the outside, and sealing members 140 that prevent entering of liquid from the outside (FIG. 9). In the fitting connector, the female terminals 10 and the male terminals 110 are electrically connected when a mutual fitted state according to insertion fitting between the female housing 20 and the male housing 120 is the completely fitted state. In this example, the male housing 120 is inserted inside the female housing 20. In this example, two sets of combination of the female terminal 10 and the male terminal 110 physically and electrically connected are provided. In the first connector 1, the two female terminals 10 are arranged side by side with a clearance therebetween in the direction (the first orthogonal direction) orthogonal to the connector insertion and removal direction. In the second connector, the two male terminals 110 are arranged side by side with a clearance therebetween in the direction (the first orthogonal direction) orthogonal to the connector insertion and removal direction.

The fitting connector is provided with a sealing member 50 that improves liquid tightness at a portion where the first connector 1 and the second connector 2 are fitted (FIGS. 7 and 8). In this example, the sealing member 50 is provided to the first connector 1. The fitting connector is further provided with a holding structure 60 between the first connector 1 and the second connector 2. The holding structure 60 holds a fitted state between the female housing 20 and the male housing 120 (hereinafter also described as the "housings") in the completely fitted state (FIGS. 1 to 3, and FIGS. 6, 7, and 9).

The female terminal 10 has a terminal connection portion 11 that physically and electrically connected to the male terminal 110 and a wire connection portion 12 that is physically and electrically connected to a wire W1 (FIG. 8). In the same manner as the female terminal 10, the male terminal 110 has a terminal connection portion 111 that is physically and electrically connected to the female terminal 10 and a wire connection portion 112 that is physically and electrically connected to a wire W2 (FIG. 9). In this example, the terminal connection portion 111 of the male terminal 110 is formed in a cylindrical shape having an axial direction matching the connector insertion and removal direction while the terminal connection portion 11 of the female terminal 10 is formed in a tubular shape matching the shape of the terminal connection portion 111 such that the terminal connection portion 111 is inserted and fitted inside the terminal connection portion 11. The wire connection portion 18 is formed in a shape allowing the wire W1 to be drawn out in its connector removal direction while the wire connection portion 112 is formed in a shape allowing the wire W2 to be drawn out in its connector removal direction. The exemplified wire connection portion 12 is crimped to a core wire W1*a* at the end portion of the wire W1 by swaging, thereby being electrically connected to the core wire W1*a*. The exemplified wire connection portion 112 is crimped to a core wire W2*a* at the end of the wire W2 by swaging, thereby being electrically connected to the core wire W2*a*.

The female housing 20 and the male housing 120 are each formed in a prescribed shape by an insulation material such as a synthetic resin material. The exemplified female housing 20 and male housing 120 each have a hood having a tubular shape having a tube axis direction matching the connector insertion and removal direction, which is described later in detail. Each hood uses its internal space as a terminal housing chamber, in which terminal holders are arranged in an integrated state. When the female housing 20 and the male housing 120 are in the fitted state, one hood is housed inside the other hood. In the housing state, the tube axes of the respective hoods substantially coincide with each other. In the fitting connector, the tube axis direction of each hood of the female housing 20 and the male housing 120 matches the connector insertion and removal direction.

Specifically, the female housing 20 has a two split structure including an outer housing 20A and an inner housing 20B (FIGS. 3 to 7).

The outer housing 20A is a tubular housing having a tube axis direction matching the connector insertion and removal direction and serves as the hood of the female housing 20. The outer housing 20A has openings at its both ends in the tube axis direction. The exemplified outer housing 20A, which is formed in a rectangular tubular shape, has a first wall body 20$A_1$ and a second wall body 20$A_2$ that are arranged, in the first orthogonal direction, to face each other with a clearance interposed therebetween and each have a substantially rectangular shape, and a third wall body 20$A_3$ and a fourth wall body 20$A_4$ that are arranged, in the second orthogonal direction, to face each other with a clearance interposed therebetween and each have a substantially rectangular shape (FIGS. 6 and 7). In the female housing 20, the inner housing 20B is housed and held in a rectangular parallelepiped internal space surrounded by the first wall body. 20$A_1$, the second wall body 20$A_2$, the third wall body 20$A_3$, and the fourth wall body 20$A_4$. An ensuring member 80 is attached to the outer housing. 20A, which is described later.

The inner housing 20B has a terminal housing portion 21 housing the female terminals 10 and terminal holding portions 22, which serve as the terminal holders and are provided for the respective female terminals 10 (FIGS. 7 and 8). The terminal housing portion 21 is formed in a tubular shape having a tube axis direction matching the connector insertion and removal direction and openings at its both ends. Inside the terminal housing portion 21, terminal housing chambers (not illustrated) are formed for the respective female terminals 10. The terminal holding portion 22 is formed in a tubular shape having a tube axis direction matching the connector insertion and removal direction and openings at its both ends. The terminal holding portion 22 extends from the opening at the end on the connector insertion direction side of the terminal housing portion 21 along the connector insertion direction. The two terminal holding portions 22 are arranged side by side for the respective female terminals 10. In this example, the terminal holding portions 22 are arranged side by side in the first orthogonal direction. Each terminal holding portion 22 has a space serving as the terminal housing chamber (not illustrated) inside thereof. The terminal housing chamber communicates with the terminal housing chamber of the terminal housing portion 21 via the opening at the end on the connector removal direction side of the terminal holding portion 22.

The female terminal 10 is inserted from the opening at the end on the connector removal direction side of the terminal holding portion 21 together with the end portion of the wire W1, and housed in the terminal housing chamber of the terminal housing portion 21 and the terminal housing chamber of the terminal holding portion 22. In the terminal housing chamber of the terminal housing portion 21, the wire connection portion 12 of the female terminal 10 and the end portion of the wire W1 connected to the wire connection portion 12 are housed. In the terminal housing chamber of the terminal holding portion 22, the terminal connection portion 11 of the female terminal 10 is housed and held. A lid member 23 having a tubular shape having openings at its both ends is attached to the end on the connector insertion direction side of the terminal holding portion 22 (FIGS. 7 and 8).

The wires W1 are drawn out externally from the opening at the end on the connector removal direction side of the terminal housing portion 21. Each terminal housing chamber of the terminal housing portion 21 is provided with the annular sealing member 40 that is concentric with the wire 1 and allows the wire W1 to pass through it. The inner circumferential surface of the sealing member 40 is tightly in contact with a coating W1*b* of the wire W1 (FIG. 8) while the outer circumferential surface of the sealing member 40 is tightly in contact with the inner circumferential surface of the terminal housing chamber of the terminal housing portion 21, thereby preventing entering of liquid (such as water) inside the terminal housing portion 22 from the wire W1 side.

The inner housing 20B is inserted into an internal space of the outer housing 20A from the opening on the connector insertion direction side of the outer housing 20A, and the removal of the inner housing 20B from the opening is prevented by a locking mechanism 24 of the terminal housing portion 21 (FIGS. 7 and 8). The locking mechanism 24 includes locking portions such as claw portions provided to the inner circumferential surface of the outer housing 20A and the terminal housing portion 21, and restricts movement of the inner housing 20B with respect to the outer housing 20A in the connector insertion direction With the insertion movement of the inner housing 20B to the internal space of outer housing 20A, the claw portion of the inner housing 20B moves over the claw portion of the outer housing 20A in the locking mechanism 24. As a result, the claw portions are disposed in a lockable state.

In the female housing 20, elastic members 25 are provided between the outer housing 20A and the inner housing 20B (FIGS. 7 and 8). The elastic members 25 are disposed at four corners on the connector removal direction side of the outer housing 20A and between a wall surface of the outer housing 20A, the surface partially covering the opening at the respective corners, and the terminal housing portion 21. Each elastic member 25 applies resilient force in the connector insertion and removal direction between the wall and the terminal housing portion 21. In this example, a helical spring is used for the elastic member 25. A shaft 21*a* into which the elastic member 25 is inserted and that supports the inserted elastic member 25 is provided for each of the four corners of the terminal housing portion 21 (FIG. 8). The respective elastic members 25 are compressed when the claw portion of the inner housing 20B moves over the claw portion of the outer housing 20A, and cause the locking portions in the locking mechanism 24 to be locked by resilient force in the expanding direction serving as the reaction force.

The shield structural body 30 prevents entering of noise from the outside to the female terminals 10 and the end portions of the wires W1 that are housed in the female housing 20. The exemplified shield structural body 30 includes a shield shell 31, a braid 32, and a connection member 33 (FIGS. 7 and 8).

The shield shell 31 is formed by a conductive material such as metal and in a tubular shape having a tube axis direction matching the connector insertion and removal direction and openings at its both ends. The terminal housing portion 21 of the inner housing 20B is disposed on the same tube axis as the shield shell 31, and the inner housing 20B is integrally formed by insert molding, for example, at the terminal housing portion 21.

After the inner housing 20B is formed, the outer circumferential surface of the end portion on the connector insertion direction side of the exemplified shield shell 31 is exposed. The exposed surface on the connector insertion direction side of the shield shell 31 is physically and electrically connected to a shield shell 131 of the second connector 2 after the completion of the fitting with the second connector 2.

The exemplified shield shell 31 protrudes from the end on the connector removal direction side of the terminal housing portion 21. The two wires W1 are drawn cut from the end on the connector removal direction side of the protruding portion of the shield shell 31. A holding member (what is called a rear holder) 26 that holds the two wires W1 are fitted inside the shield shell 31 (FIG. 8). The holding member 26 is formed of an insulation material such as a synthetic resin. The outer circumferential surface of the protruding portion of the shield shell 31 is covered with the braid 32 together with the drawn out wires W1. The braid 32 is a member formed by knitting a conductive material such as metal in a meshed tubular shape. The connection member 33 is connected to the shield shell 31 with the braid 32 interposed therebetween. The exemplified connection member 33 is fitted inside the shield shell 31 to press the braid 32 on the inner circumferential surface of the shield shell 31, thereby holding electrical connection state between the shield shell 31 and the braid 32.

Figure 1:
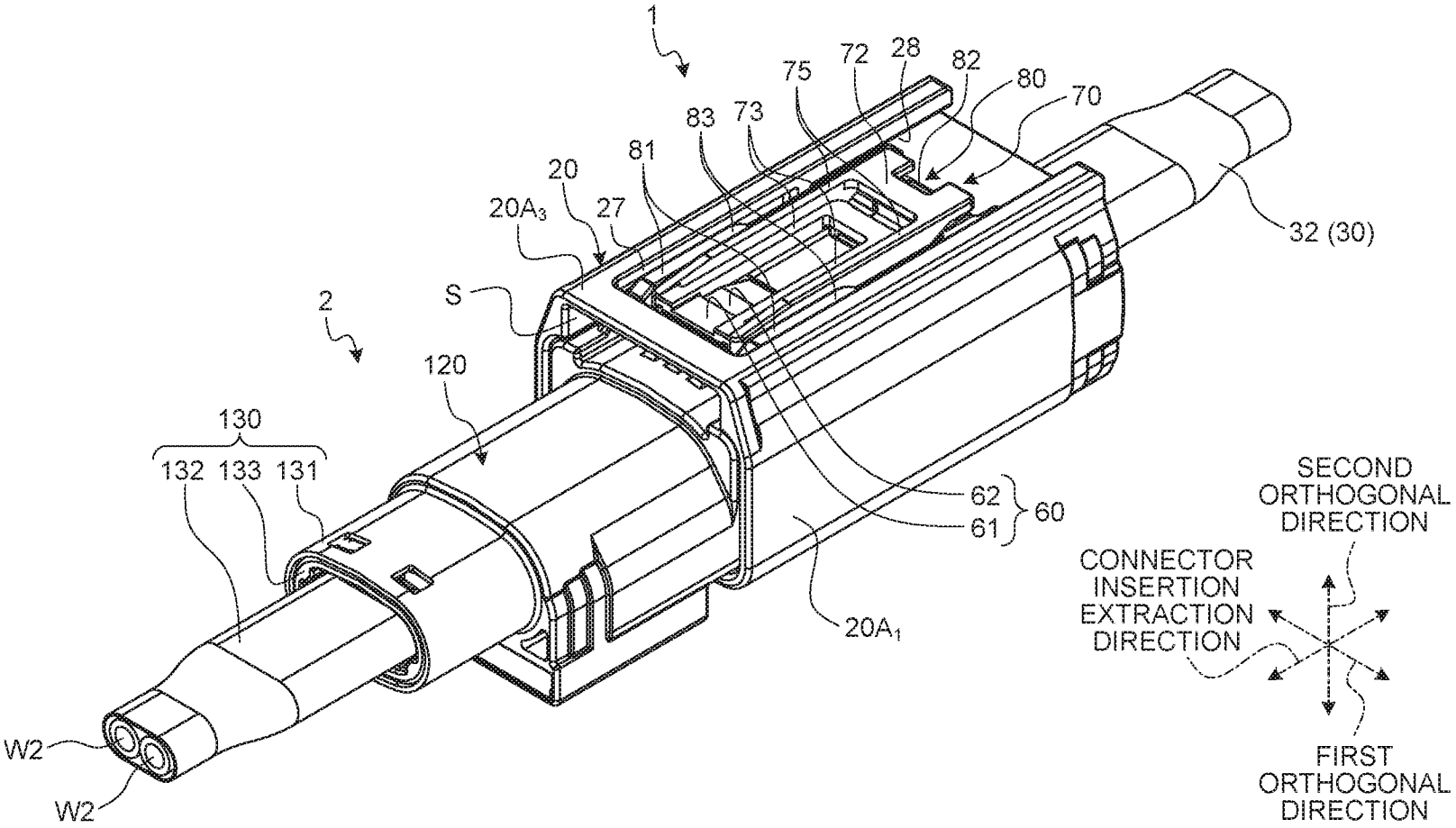
FIG. 1 is a perspective view illustrating a fitting connector when an ensuring member is at a main locking position.

In the exemplified first connector 1, a tubular space S having an end opening on the connector insertion direction side is formed between the outer housing 20A and the inner housing 20B and between the outer housing 20A and the shield shell 31 on the connector insertion direction side of the exposed surface on the connector insertion direction side of the shield shell 31 (FIGS. 1 and 6). The second connector 2 is fitted in the first connector 1 while being inserted into the tubular space S from the opening of the tubular space S. In the insertion, a portion on the connector insertion direction side of the second connector 2 is housed inside the outer housing 20A. The end portion on the connector insertion direction side of the terminal housing portion 21, the end portion on the connector insertion direction side of the shield shell 31, and the terminal holding portions 22 are inserted inside the male housing 120 on the connector insertion direction side of the second connector 2. The male terminals 110 are inserted inside the terminal connection portions 11 via the openings of the terminal holding portions 22 as the insertion proceeds. The sealing member 50 is, thus, formed in an annular shape and allows the end portion on the connector insertion direction side of the terminal housing portion 21 to pass through it. The inner circumferential surface of the sealing member 50 is tightly in contact with the end portion of the terminal housing portion 21 while the outer circumferential surface of the sealing member 50 is tightly in contact with the inner circumferential surface of the male housing 120 inserted into the space S. The opening at the end on the connector insertion direction side of the terminal housing portion 21 is closed except for the sections communicating with the terminal holding portions 22.

The male housing 120 is a counterpart tubular housing having a tube axis direction matching the connector insertion and removal direction. The male housing 120 is inserted and fitted inside the internal space (the tubular space S of the first connector 1) of the female housing 20. The male housing 120 has a terminal housing portion 121 housing the male terminals 110 and a terminal holding portion 122 having a function of the terminal holder for the respective male terminals 110 (FIGS. 6 and 9). The terminal housing portion 121 is formed in a tubular shape having a tube axis direction matching the connector insertion and removal direction and openings at its both ends. The terminal housing portion 121 has terminal housing chambers (not illustrated) that are formed inside thereof for the respective male terminals 110. The end portion on the connector insertion direction side of the terminal housing portion 121 forms the hood, which is inserted into the tubular space S of the first connector 1. The outer circumferential surface of the sealing member 50 is tightly in contact with the inner circumferential surface of the end portion. The exemplified terminal housing portion 121 is formed in a tubular shape matching the shape of the outer circumferential surface of the terminal housing portion 21 of the inner housing 20B and the shape of the outer circumferential surface of the shield shell 31. The terminal holding portion 122 formed in a tubular shape having a tube axis direction matching the connector insertion and removal direction and openings at its both ends. The terminal holding portion 122 has terminal housing chambers (not illustrated) that are formed inside thereof for the respective male terminals 110. The terminal holding portion 122 is disposed on the opening at the end on the connector removal direction side of the terminal housing portion 121. The terminal housing chambers of the terminal holding portion 122 communicate with the terminal housing chambers of the terminal housing portion 121 via the opening at the end on the connector insertion direction side of the terminal holding portion 122.

The male terminals 110 are inserted from the opening at the end on the connector removal direction side of the terminal holding portion 122 together with the end portions of the wires W2, and housed in the terminal housing chambers of the terminal housing portion 121 and the terminal housing chambers of the terminal holding portion 122. The terminal connection portions 111 of the male terminals 110 are housed in the terminal housing chambers of the terminal housing portion 121. The wire connection portions 112 of the male terminals 110 and the end portions of the wires W2 connected to the wire connection portions 112 are housed in the terminal housing chambers of the terminal holding portion 122.

The wires W2 are drawn out externally from the opening at the end on the connector removal direction side of the terminal holding portion 122. Annular sealing members 140 are provided for the respective terminal housing chambers of the terminal holding portion 122. The sealing member 140 is concentric with the wire W2 and allows the wire W2 to pass through it (FIG. 9). The inner circumferential surface of the sealing member 140 is tightly in contact with a coating W2*b* of the wire W2 while the outer circumferential surface of the sealing member 140 is tightly in contact with the inner circumferential surface of the terminal housing chamber of the terminal holding portion 122, thereby preventing entering of liquid (such as water) inside the terminal housing chamber 121 from the wire W2 side.

The shield structural body 130 prevents entering of noise from the outside to the male terminals 110 and the end portions of the wires W2 that are housed in the male housing 120. The exemplified shield structural body 130 includes a shield shell 131, a braid 132, and a connection member 133 (FIGS. 6 and 9).

The shield shell 131 is formed by a conductive material such as metal and in a tubular shape having a tube axis direction matching the connector insertion and removal direction and openings at its both ends. The shield shell 131 is disposed from the terminal housing portion 121 to the terminal holding portion 122 of the male housing 120, and formed integrally with the male housing 120 by insert molding.

After the male housing 120 is formed, the inner circumferential surface of the end portion on the connector insertion direction side of the exemplified shield shell 131 is exposed. The exposed surface on the connector insertion direction side of the shield shell 131 is physically and electrically connected to the shield shell 31 of the first connector 1 after the completion of the fitting with the first connector 1.

The exemplified shield shell 131 protrudes from the end on the connector removal direction side of the male housing 120. The two wires W2 are drawn out from the end on the connector removal direction side of the protruding portion of the shield shell 131. A holding member (what is called a rear holder) 126 that holds the two wires W2 are fitted inside the shield shell 131 (FIG. 9). The holding member 126 is formed of an insulation material such as a synthetic resin. The outer circumferential surface of the protruding portion of the shield shell 131 is covered with the braid 132 together with the drawn out wires W2. The braid 132 is a member formed by knitting a conductive material such as metal in a meshed tubular shape. The connection member 133 is connected to the shield shell 131 with the braid 132 interposed therebetween. The exemplified connection member 133 is fitted inside the shield shell 131 to press the braid 132 on the inner circumferential surface of the shield shell 131, thereby holding electrical connection state between the shield shell 131 and the braid 132.

In the fitting connector, the holding structure 60 restricts relative movement between the housings in the respective connector removal directions such that the female housing 20 and the male housing 120 are held in the completely fitted state when the fitted state between the female housing 20 and the male housing 120 is the completely fitted state. The holding structure 60 includes a first locking holding portion 61 provided to the female housing 20 and a second locking holding portion 62 provided to the male housing 120 (FIGS. 1 to 3 and FIG. 6). The holding structure 60 causes the first locking holding portion 61 and the second locking holding portion 62 to be in a lockable state in the respective connector removal directions and to hold the fitted state in the completely fitted state when the fitted state between the female housing 20 and the male housing 120 is the completely fitted state.

The holding structure 60 includes a locking holder 70 that is provided with the first locking holding portion 61 (FIGS. 1 to 7). The locking holder 70 is provided to the female housing 20. In this example, the locking holder 70 is formed integrally with the outer housing 20A.

The locking holder 70 has the first locking holding portion 61 provided at one end thereof in the connector insertion and removal direction and a locking release operation portion 72 provided at the other end thereof in the connector insertion and removal direction (FIGS. 1 to 3, and FIGS. 6 and 7). The exemplified locking holder 70 has the first locking holding portion 61 provided at one end of the outer housing 20A on the connector insertion direction side and the locking release operation portion 72 provided at the other end of the outer housing 20A on the connector removal direction side. The locking release operation portion 72 is operated by being pushed when a lockable state or a locked state between the first locking holding portion 61 and the second locking holding portion 62 is intended to be released.

The locking holder 70 is provided with the first locking holding portion 61 at a free end thereof, and further has cantilever locking arm portions 73 disposed between the first locking holding portion 61 and the locking release operation portion 72 (FIGS. 1 to 3, and FIGS. 6 and 7). The locking arm portions 73 extend in the connector insertion and removal direction. The fixed ends of the locking arm portions 73 are connected to an outer wall surface of the outer housing 20A. The locking holder 70 is connected to the outer wall surface of the outer housing 20A via the fixed ends of the locking arm portions 73 in a cantilever state. In the locking holder 70, the locking release operation portion 72 is disposed on the connector removal direction side of the fixed ends of the locking arm portions 73.

Figure 2:
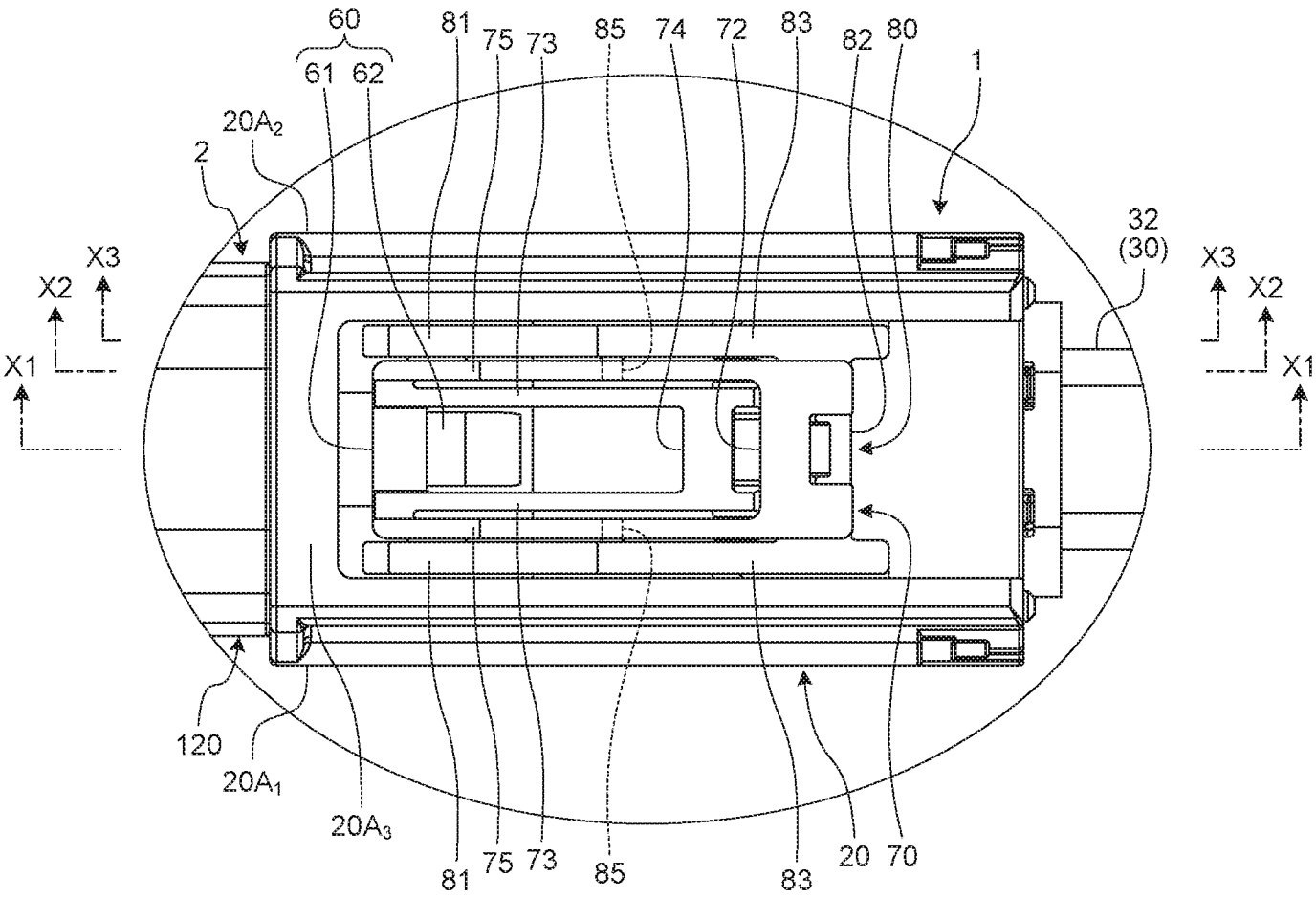
FIG. 2 is a plan view illustrating the fitting connector when the ensuring member is at the main locking position, and a partially enlarged view of a periphery of a holding structure and the ensuring member.

The exemplified locking holder 70 has two locking arm portions 73 arranged with a clearance therebetween in the first orthogonal direction. The rectangular flat plate-shaped piece portion connecting the free ends of the respective locking arm portions 73 is used as the first locking holding portion 61 (FIGS. 1, 2, 6, and 7). In the exemplified locking holder 70, the portions on the fixed end side of the two locking arm portions 73 are connected with a coupling portion 74 (FIG. 2).

Figure 4:
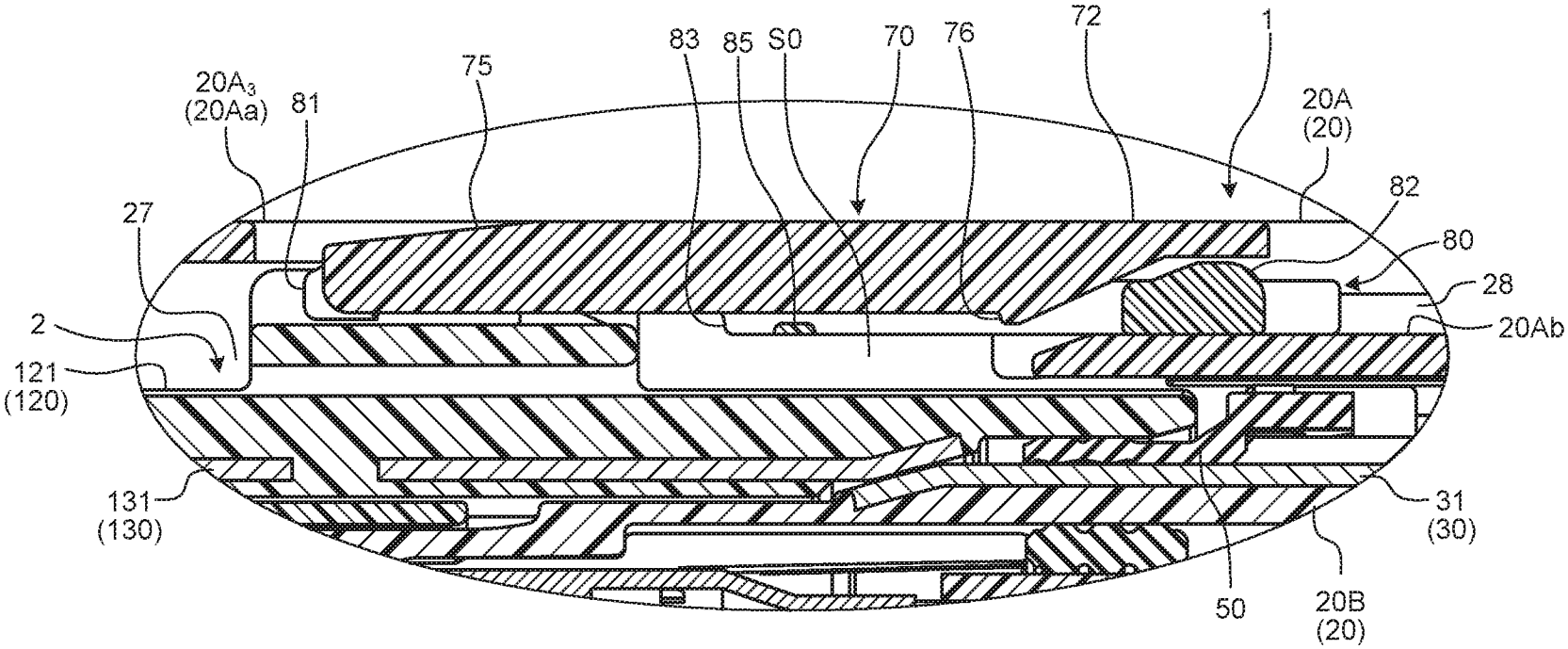
FIG. 4 is a cross-sectional view taken along line X2-X2 in FIG. 2.

The locking holder 70 further has locking release arm portions 75 that couple the first locking holding portion 61 and the locking release operation portion 72 (FIGS. 1, 2, 6, and 7). The locking release arm portions 75 extend in the connector insertion and removal direction. The locking release arm portions 75 apply force corresponding to push operation force (release operation force) on the first locking holding portion 61 when the locking release operation portion 72 is operated by being pushed. The locking holder 70 has fulcrum portions 76 provided to the locking release arm portions 75 (FIG. 4). The fulcrum portions 76 are disposed between the first locking holding portion 61 and the locking release operation portion 72. In the locking holder 70, the fulcrum portions 76 are provided on a side adjacent to the locking release operation portion 72. In the holding structure 60, receiving portions (hereinafter described as "release operation force receiving portions") 85 that receive force when the push operation force (release operation force) is applied to the locking release operation portion 72 are provided corresponding to the fulcrum portions 76 (FIG. 4). The fulcrum portions 76 apply force on the first locking holding portion 61 serving as the point of effort in a removal direction from the second locking holding portion 62 with the contact points with the release operation force receiving portions 85 as the fulcrums when the locking release operation portion 72 serving as the point of load is operated by being pushed. For the fulcrum portion 76, part of a wall surface of the locking release arm portion 75 may be used. For the fulcrum portion 76, a protrusion protruding from the wall surface of the locking release arm portion 75 may be used. In this example, the fulcrum portions 76 serving as protrusions are provided to the locking release arm portions 75. The release operation force receiving portion 85 is described later in detail.

The exemplified locking holder 70 has the two locking release arm portions 75 that are arranged to interpose the two locking arm portions 73 in the first orthogonal direction One locking release arm portion 75 is disposed to face one locking arm portion 73 in the first orthogonal direction with a clearance therebetween. The other locking release arm portion 75 is disposed to face the other locking arm portion 73 in the first orthogonal direction with a clearance therebetween. One end on the connector insertion direction side of each locking release arm portion 75 is connected to the first locking holding portion 61 while the other end on the connector removal direction side of each locking release arm portion 75 is connected to the locking release operation portion 72.

Figure 3:
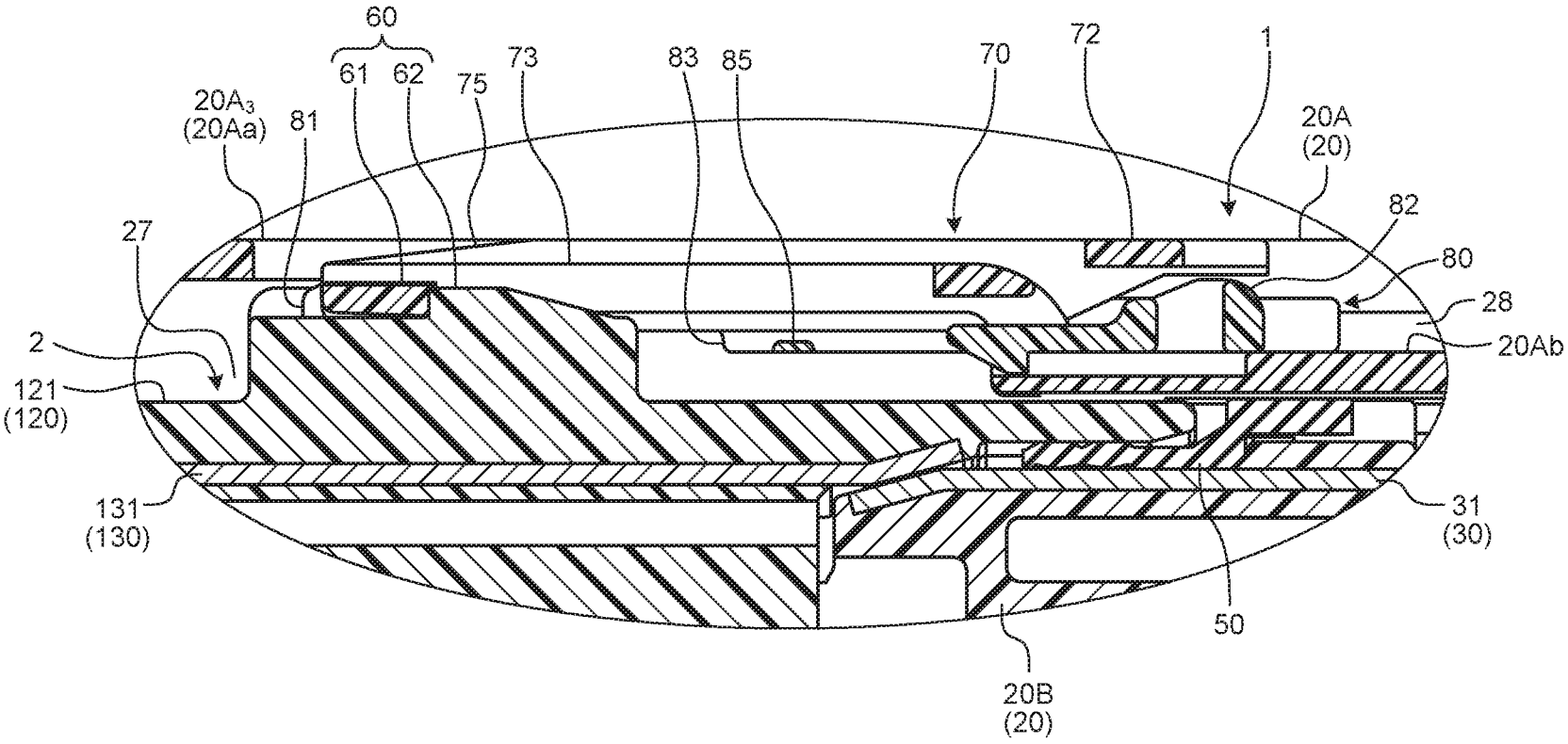
FIG. 3 is a cross-sectional view taken along line X1-X1 in FIG. 2.

The second locking holding portion 62 is formed as a protrusion that is inserted into a space surrounded by the first locking holding portion 61 and the two locking arm portions 73 of the locking holder 70 and disposed to face the first locking holding portion 61 in the removal direction when the fitted state between the housings is the completely fitted state. In the holding structure 60, the second locking holding portion 62 protrudes from the outer wall surface of the terminal housing portion 121 of the male housing 120 (FIGS. 3, 6, and 9).

In this example, the outer housing 20A is provided with a through hole 27 on an outer peripheral wall thereof (FIG. 1 and FIGS. 3 to 7). The locking holder 70 disposes a space into which the second locking holding portion 62 is inserted such that the space faces at least the through hole 27. In the through hole 27, the second locking holding portion 62 provided on the outer wall surface of the male housing 120 is disposed to face the first locking holding portion 61 when the fitted state between the housings is the completely fitted state.

Specifically, the exemplified outer housing 20A has a main outer wall surface 20Aa forming its outer shape and a sub outer wall surface 20Ab offset from the main outer wall surface 20Aa to a side closer to the internal space than the main outer wall surface 20Aa, as the outer wall surface (FIGS. 3 to 5 and FIG. 7).

In the locking holder 70, the fixed ends of the locking arm portions 73 are connected to the sub outer wall surface 20Ab. The locking holder 70 is, thus, disposed on the side closer to the internal space than the main outer wall surface 20Aa. The through hole 27 is formed on the connector insertion direction side of the sub outer wall surface 20Ab. The exemplified locking holder 70 is, thus, disposed in the through hole 27 except for the fixed ends of the locking arm portions 73 and the portion on the connector removal direction side of the fixed ends, and is disposed to face the outer wall surface of the terminal housing portion 121 with a clearance therebetween. In the exemplified locking holder 70, the locking release operation portion 72 is, thus, disposed to face the sub outer wall surface 20Ab with a clearance therebetween in the second orthogonal direction.

In the fitting connector, with proceeding of insertion fitting operation between the housings, the first locking holding portion 61 moves on the second locking holding portion 62 together with the elastic deformation of the locking arm portions 73. In the fitting connector, when the fitted state between the housings becomes the completely fitted state, the first locking holding portion 61 moves over the second locking holding portion 62, and then the first locking holding portion 61 and the second locking holding portion 62 are disposed to face each other in the respective connector removal directions together with disappearance of the elastic deformation of the locking arm portions 73 (FIGS. 1 to 3). As a result, in the holding structure 60, the first locking holding portion 61 and the second locking holding portion 62 are in the lockable state.

In the exemplified fitting connector, when the first connector 1 and the second connector 2 are in the insertion fitting, the respective elastic members 25 are compressed by push force from the second connector 2 side to the inner housing 20B. In the fitting connector, when the fitted state between the housings becomes the completely fitted state, the male housing 120 is pushed back by resilient force in the extension direction of the respective elastic members 25 via the inner housing 20B, thereby causing the first locking holding portion 61 and the second locking holding portion 62 to be locked. The elastic members 25 of the first connector 1 each apply resilient force on the first connector 1 and the second connector 2 in the respective connector removal directions when the fitted state between the housings is the completely fitted state. The resilient force causes the first locking holding portion 61 and the second locking holding portion 62 to be in the fitted state in the respective connector removal directions, and causes the fitted state to be held in the completely fitted state.

In the holding structure 60, the locking release operation portion 72 is operated by being pushed toward the sub outer wall surface 20Ab when the lockable state or the locked state between the first locking holding portion 61 and the second locking holding portion 62 is intended to be eliminated. In the holding structure 60, the locking release arm portions 75 perform seesaw movement with the contact points between the fulcrum portions 76 and the release operation force receiving portions 85 as the fulcrums and apply force on the first locking holding portion 61 in the removal direction from the second locking holding portion 62 in the second orthogonal direction. In the holding structure 60, the first locking holding portion 61 is lifted and removed from the second locking holding portion 62 in the second orthogonal direction, and the facing arrangement state between the first locking holding portion 61 and the second locking holding portion 62 in the respective connector removal directions is eliminated. In other words, in the fitting connector, the completely fitted state between the first connector 1 and the second connector 2 by the holding structure 60 can be firmly established by restricting the movement of the first locking holding portion 61 in the removal direction from the second locking holding portion 62.

The fitting connector is, thus, provided with the ensuring member 80 that restricts the movement of the first locking holding portion 61 in the removal direction from the second locking holding portion 62 when the fitted state between the housings is the completely fitted state, and ensures that the fitted state is the completely fitted state (FIGS. 1 to 5). The ensuring member 80 restricts the movement of the first locking holding portion 61 in the removal direction, and holds the lockable state between the first locking holding portion 61 and the second locking holding portion 62, thereby ensuring that the fitted state is the completely fitted state.

The ensuring member 80 can relatively move with respect to the female housing 20 in the connector insertion and removal direction. The ensuring member 80 is assembled to the female housing 20 such that the ensuring member 80 can perform the relative movement between a main locking position and a temporary locking position. At the main locking position, the ensuring member 80 restricts the movement of the first locking holding portion 61 in the removal direction from the second locking holding portion 62 when the fitted state between the housings is the completely fitted state. At the temporary locking position, the ensuring member 80 does not restrict the movement of the first locking holding portion 61 in the removal direction from the second locking holding portion 62 when the fitted state between the housings is the completely fitted state. The exemplified ensuring member 80 is assembled to be capable of relatively moving with respect to the outer housing 20A in the connector insertion and removal direction.

The main locking position is defined as the position at which position restriction portions 81 restrict the movement of the first locking holding portion 61 in the removal direction from the second locking holding portion 62 in the relative positions of the ensuring member 80 with respect to the female housing 20 (FIGS. 1 and 2). The ensuring member 80 performs locking on a side adjacent to the first locking holding portion 61 of the locking holder 70 at the main locking position, thereby restricting the movement of the first locking holding portion 61 in the removal direction from the second locking holding portion 62. The exemplified ensuring member 80 causes the position restriction portions 81 to lock locked portions 77 of the locking holder 70 at the main locking position, thereby restricting the movement of the first locking holding portion 61 in the removal direction from the second locking holding portion 62 (FIG. 5). The locked portions 77 are protrusions that protrude from both sides of the first locking holding portion 61 in the first orthogonal direction toward the first orthogonal direction such that each locked portion 77 protrudes outside the corresponding locking release arm portion 75. The locked portion 77 is provided for each locking release arm portion 75. The exemplified locked portion 77 is formed in a rectangular flat plate shape and is disposed such that its thickness direction faces the second orthogonal direction.

Figure 10:
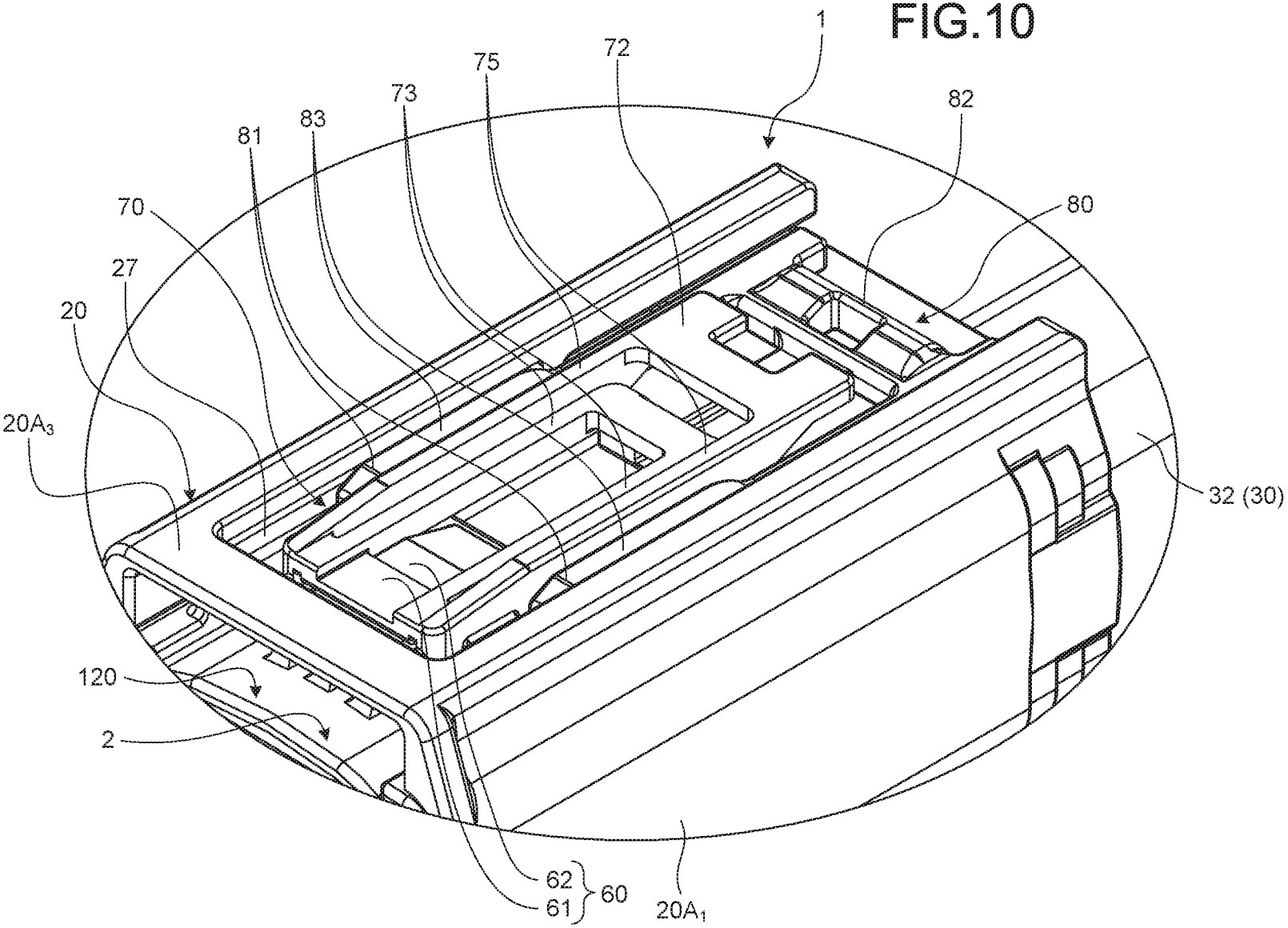
FIG. 10 is a perspective view illustrating the fitting connector when the ensuring member is at a temporary locking position, and a partially enlarged view of a periphery of the holding structure and the ensuring member.
Figure 11:
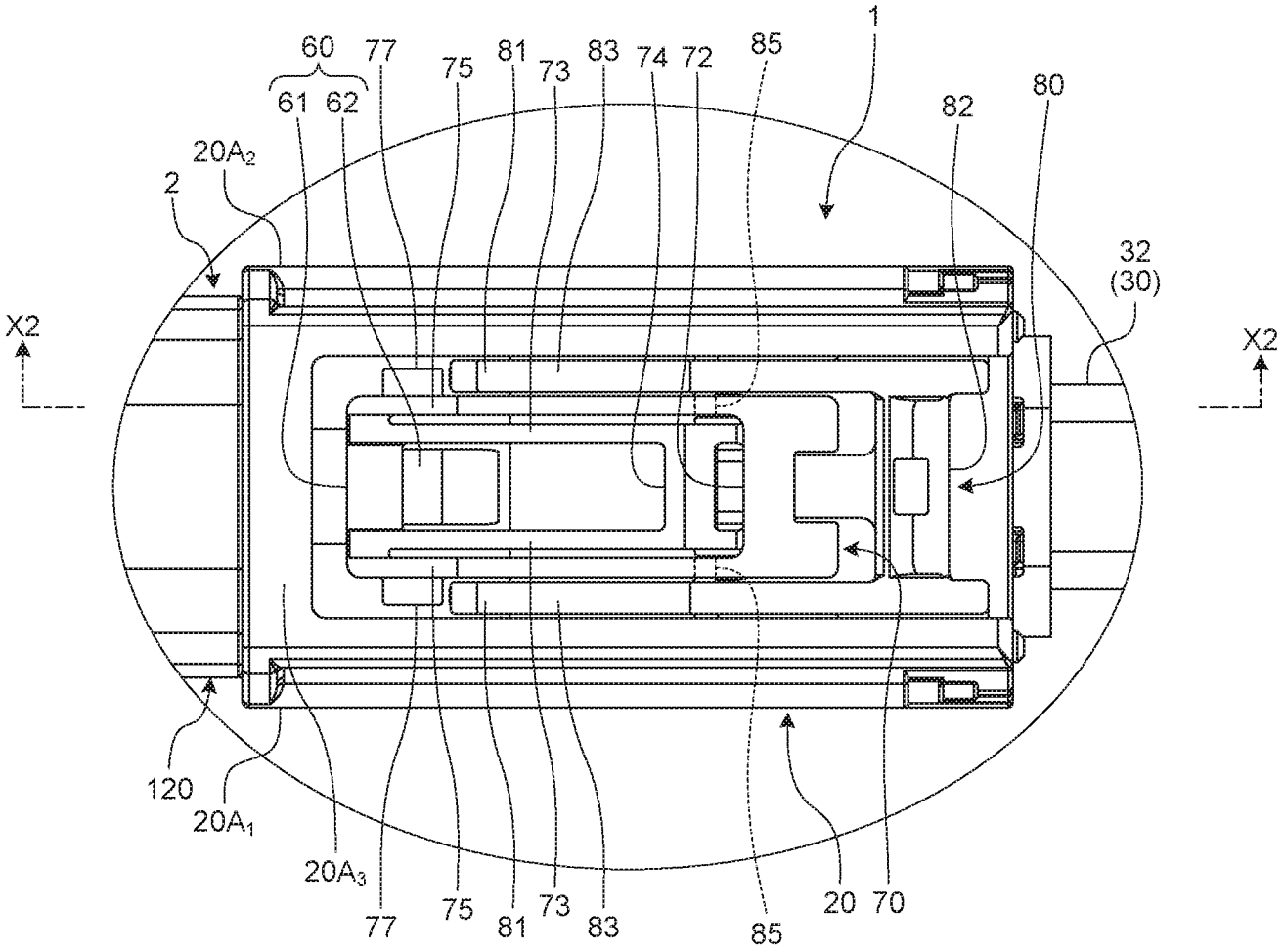
FIG. 11 is a plan view illustrating the fitting connector when the ensuring member is at the temporary locking position, and a partially enlarged view of a periphery of the holding structure and the ensuring member.

The temporary locking position is defined as the position at which the position restriction portions 81 do not restrict the movement of the first locking holding portion 61 in the removal direction from the second locking holding portion 62 in the relative positions of the ensuring member 80 with respect to the female housing 20 (FIGS. 10 and 11). The exemplified ensuring member 80 causes the position restriction portions 81 not to lock the locked portions 77 of the locking holder 70 at the temporary locking position, thereby failing to restrict the movement of the first locking holding portion 61 in the removal direction from the second locking holding portion 62 (FIG. 11).

The ensuring member 80 has the position restriction portions 81, an operation portion 82, and cantilever position restriction arm portions 83 (FIGS. 1 to 7). The position restriction portions 81 lock the locked portions 77 on the first locking holding portion side of the locking holder 70 to restrict the movement of the first locking holding portion 61 in the removal direction from the second locking holding portion 62 at the main locking position. The operation portion 82 is operated when the ensuring member 80 is relatively moved with respect to the female housing 20 in the connector insertion and removal direction. The position restriction arm portions 83 each provided with the position restriction portion 81 at its free end and each disposed between the position restriction portion 81 and the operation portion 82. In the exemplified ensuring member 80, the operation portion 82 is disposed on the connector removal direction side of the position restriction portions 81.

Specifically, the position restriction portions 81 are formed to restrict the movement of the first locking holding portion 61 in the removal direction from the second locking holding portion 62 when the fitted state between the housings is the completely fitted state and the relative position of the ensuring member 80 with respect to the female housing 20 is the main locking position. The exemplified position restriction portions 81 lock the locked portions 77 moved integrally with the first locking holding portion 61, thereby restricting the movement of the first locking holding portion 61 in the removal direction from the second locking holding portion 62 (FIG. 5). The position restriction portions 81 are also formed to fail to restrict the movement of the first locking holding portion 61 in the removal direction from the second locking holding portion 62 when the fitted state between the housings is not the completely fitted state, or when the fitted state between the housings is the completely fitted state and the relative position of the ensuring member 80 with respect to the female housing 20 is the temporary locking position. The exemplified position restriction portions 81 do not lock the locked portions 77, thereby failing to restrict the movement of the first locking holding portion 61 in the removal direction from the second locking holding portion 62 (FIG. 11).

The exemplified position restriction portions 61 are formed to be disposed to face the locked portions 77 on the removal direction side of the first locking holding portion 61 when the ensuring member 80 is at the main locking position, and the position restriction portions 81 are disposed not to face the locked portions 77 on the removal direction side of the first locking holding portion 61 when the fitted state between the housings is not the completely fitted state or the ensuring member 80 is at the temporary locking position. The exemplified position restriction portions 81 are also formed to be disposed to face the locked portions 77 on the connector insertion direction side of the locked portions 77 when the ensuring member 80 is at the main locking position. The position restriction portion 81 is provided for each locked portion 77.

The operation portion 82 is formed to be disposed on the connector removal direction side of the locking holder 70 when the ensuring member 80 is at the temporary locking position. The operation portion 82 may be formed to be disposed on the connector removal direction side of the locking holder 70 when the ensuring member 80 is at the main locking position. The operation portion 82 may be formed to lock the locking release operation portion 72 operated by being pushed when the ensuring member 80 is at the main locking position.

The exemplified ensuring member 80 is formed to enter a space on the push operation direction side of the locking release operation portion 72 on the locking release operation portion 72 side of the fulcrum portions 76 of the locking holder 70 when the ensuring member 80 is at the main locking position, and locks the portion on the locking release operation portion 72 side of the fulcrum portions 76 of the locking holder 70 when the locking release operation portion 72 is operated by being pushed. The exemplified ensuring member 80 locks the portion on the locking release operation portion 72 side of the fulcrum portions 76 of the locking holder 70 so as to prevent transmission of force according to the push operation to the first locking holding portion 61 even when the locking release operation portion 72 is operated by being pushed when the ensuring member 80 is at the main locking position. In this example, when the ensuring member 80 is at the main locking position, the operation portion 82 enters the space between the locking release operation portion 72 and the sub outer wall surface 20Ab, thereby restricting the movement of the locking release operation portion 72 according to the push operation (FIGS. 1 to 4). The exemplified fitting connector can prevent release of the lockable state or the locked state between the first locking holding portion 61 and the second locking holding portion 62 even when the locking release operation portion 72 is operated by being pushed when the ensuring member 80 is at the main locking position.

The ensuring member 80 has the position restriction portions 81 provided at its free end and the cantilever position restriction arm portions 83 provided between the position restriction portion 81 and the operation portion 82 (FIGS. 1 to 7). The position restriction arm portion 83 is provided for each position restriction portion 81 and extends in the connector insertion and removal direction. The position restriction arm portion 83 has one end in the connector insertion direction as its free end and the other end in the connector insertion direction as the fixed end. The fixed end is connected to the operation portion 82. The position restriction arm portions 83 are disposed to interpose the two locking release arm portions 75 in the first orthogonal direction regardless of the relative position of the ensuring member 80 with respect to the female housing 20. One position restriction arm portion 83 is disposed to face one locking release arm portion 75 in the first orthogonal direction with a clearance therebetween. The other position restriction arm portion 83 is disposed to face the other locking release arm portion 75 in the first orthogonal direction with a clearance therebetween.

The operation portion 82 of the ensuring member 80 is pushed on the connector insertion direction side thereof when the ensuring member 80 is at the temporary locking position. As a result, the ensuring member 80 relatively moves with respect to the female housing 20 in the connector insertion direction to the main locking position. The ensuring member 80 has guided portions 84 guided when the ensuring member 80 relatively moves with respect to the female housing 20 (FIG. 7). The outer housing 20A of the female housing 20 has guide portions 28 that guide the guided portions 84 when the ensuring member 80 relatively moves with respect to the female housing 20 (FIG. 1, FIGS. 3 to 5, and FIG. 7). In the exemplified ensuring member 80, rectangular piece portions protrude from both ends in the first orthogonal direction of the operation portion 82 and the position restriction arm portions 83. The rectangular piece portions serve as the guided portions 84. The guided portion 84 is formed such that its thickness direction matches the second orthogonal direction. The guide portion 28 is a groove extending in the connector insertion and removal direction and provided for each guided portion 84. The guide portions 28 guide the guided portions 84 in the connector insertion and removal direction while each flat surface of the guided portions 84 is locked by corresponding one of two wall surfaces of the guide portions 28, the two wall surfaces being arranged to face in the second orthogonal direction with a clearance therebetween.

The ensuring member 80 has the release operation force receiving portions 85 described above (FIGS. 2 to 4 and FIG. 7). In the ensuring member 80, the release operation force receiving portions 85 are arranged at such positions that they are not in contact with the fulcrum portions 76 when the locking release operation portion 72 is operated by being pushed while the ensuring member 80 is at the main locking position, and they are in contact with the fulcrum portions 76 when the locking release operation portion 72 is operated by being pushed while the ensuring member 80 is at the temporary locking position. The exemplified release operation force receiving portions 85 are provided to the position restriction arm portions 83. In this example, the release operation force receiving portion 85 is provided for each position restriction arm portion 83.

The exemplified release operation force receiving portion 85 is a protrusion that protrudes from the position restriction arm portion 83 toward an inward of the position restriction arm portion 83 the first orthogonal direction (i.e., on a side adjacent to the locking release arm portion 75), and to a position between the locking release arm portion 75 and the outer wall surface of the terminal housing portion 121 in the second orthogonal direction. In this example, the release operation force receiving portion 85 is formed in a rectangular flat plate shape and disposed such that its thickness direction faces the second orthogonal direction.

Figure 12:
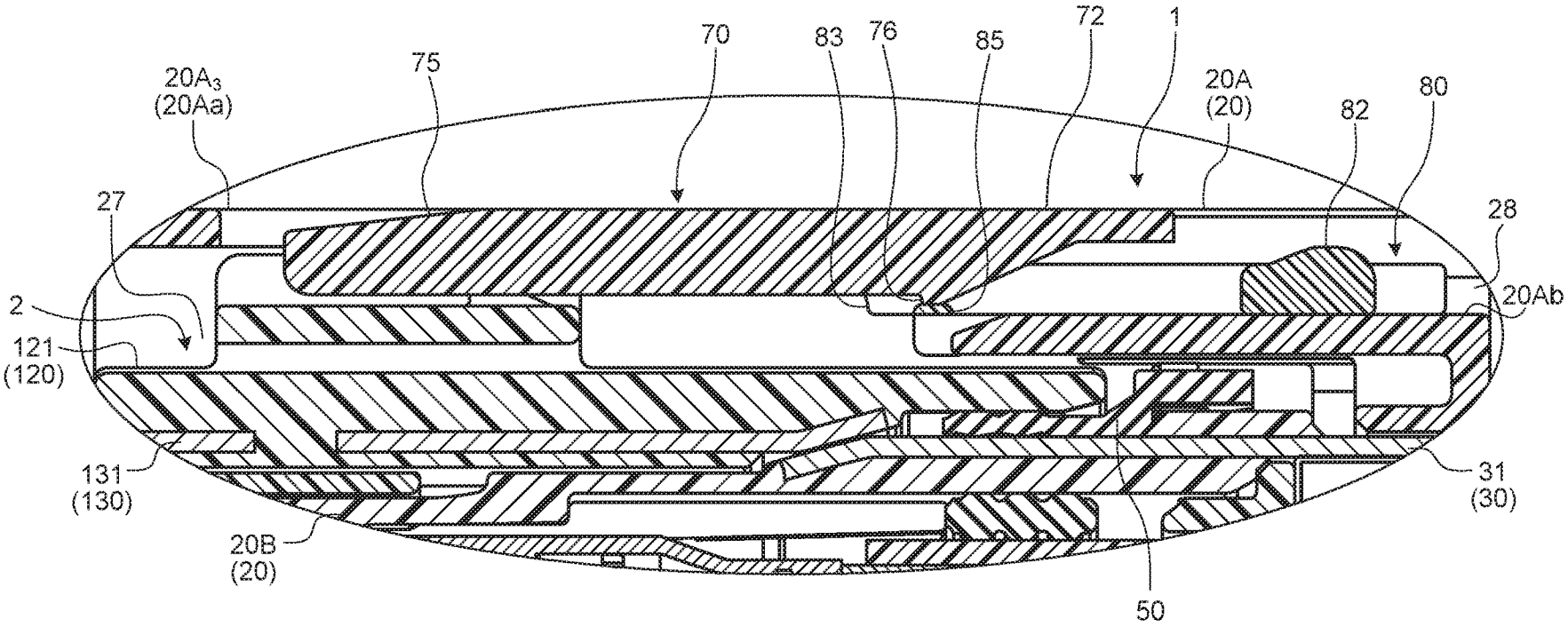
FIG. 12 is a cross-sectional view taken along line X2-X2 in FIG. 11.

In the fitting connector, when the ensuring member 80 is at the temporary locking position, the release operation force receiving portion 85 is present on a trajectory of the fulcrum portion 76 according to the push operation on the locking release operation portion 72 (FIG. 12). In the fitting connector, when the locking release operation portion 72 is operated by being pushed while the ensuring member 80 is at the temporary locking position, the fulcrum portions 76 and the release operation force receiving portions 85 are in contact with. As a result, fulcrums are formed that are necessary for locking release operation between the first locking holding portion 61 and the second locking holding portion 62 in the holding structure 60. In the fitting connector, when the locking release operation portion 72 is operated by being pushed while the ensuring member 80 is at the temporary locking position, the lockable state or the locked state between the first locking holding portion 61 and the second locking holding portion 62 is released, thereby making it possible for the first connector 1 and the second connector 2 to be pulled out from each other. In this example, the fulcrum portions 76 and the release operation force receiving portions 85 are in contact with each other regardless of the presence or the absence of push operation on the locking release operation portion 72 when the ensuring member 80 is at the temporary locking position.

In the fitting connector, when the ensuring member 80 is at the main locking position, the release operation force receiving portion 85 is absent on the trajectory of the fulcrum portion 76 according to the push operation on the locking release operation portion 72 (FIG. 4). In the fitting connector, even when the locking release operation portion 72 is operated by being pushed while the ensuring member 80 is at the main locking position, the fulcrum portions 76 and the release operation force receiving portions 85 are not in contact with each other. As a result, no fulcrums are formed that are necessary for locking release operation of the holding structure 60. In the fitting connector, even when the locking release operation portion 72 is operated by being pushed while the ensuring member 80 is at the main locking position, the lockable state or the locked state between the first locking holding portion 61 and the second locking holding portion 62 is not released.

For example, when wrong operation is performed on the locking release operation portion 72 while the ensuring member 80 is at the main locking position, the fitting connector can prevent operation of the locking release function of the holding structure 60. For another example, when the locking release operation portion 72 is operated by being pushed by a peripheral part or when external input such as vibration is applied to the locking release operation portion 72 while the ensuring member 80 is at the main locking position, the fitting connector can prevent operation of the locking release function of the holding structure 60. Furthermore, the fitting connector can prevent operation of the locking release function of the holding structure 60 even when aging occurs in the fitting connector, for example, because the fulcrum portions 76 and the release operation force receiving portions 85 are not in contact with each other when the ensuring member 80 is at the main locking position. As described above, the fitting connector in the embodiment can disable unintentional operation of the locking release function in the holding structure 60 when the ensuring member 80 is at the main locking position.

In the exemplified fitting connector, the operation portion 82 enters the space between the locking release operation portion 72 and the sub outer wall surface 20Ab when the ensuring member 80 is at the main locking position. The fitting connector can also prevent unintentional operation of the locking release function in the holding structure 60 by the operation portion 82 in addition to the preventive structure described above.

The fitting connector can also disable unintentional operation of the locking release function in the holding structure 60 when the ensuring member 80 is at the main locking position without entering of the operation portion 82 to the space between the locking release operation portion 72 and the sub outer wall surface 20Ab. The ensuring member 80 does not need to cause the operation portion 82 to have the locking function of the locking release operation portion 72. As a result, the ensuring member 80 can be downsized. With the downsizing of the ensuring member 80, the fitting connector can also be downsized. In this case, the female housing 20 preferably has a space S0 (FIG. 4). When the ensuring member 80 is at the main locking position, the portion on the locking release operation portion 72 side of the first locking holding portion 61 of the locking holder 70 enters the space S0 by the push operation on the locking release operation portion 72.

The space S0 may be formed such that the portion on the locking release operation portion 72 side of the first locking holding portion 61 of the locking holder 70 is not locked by the push operation on the locking release operation portion 72, for example. As a result, no fulcrums are formed not only between the fulcrum portions 76 and the release operation force receiving portions 85 but also between the locking release arm portions 75 and its peripheral part even when the locking release operation portion 72 is operated by being pushed when the ensuring member 80 is at the main locking position. The fitting connector, thus, can firmly disable unintentional operation of the locking release function in the holding structure 60 when the ensuring member 80 is at the main locking position.

The space S0 may be formed such that the locking release operation portion 72 is locked with respect to its peripheral part first when the push operation is performed on the locking release operation portion 72. The space S0 is formed such that the locking release operation portion 72 is locked with respect to its peripheral part first even though the portion on the locking release operation portion 72 side of the first locking holding portion 61 of the locking holder 70 is locked with respect to the peripheral part when the push operation is performed on the locking release operation portion 72. In other words, the space S0 is formed such that even when the push operation continues to be operated on the locking release operation portion 72 after being locked, the locking release operation portion 72 is not pushed any further. As a result, even when the push operation is performed on the locking release operation portion 72 when the ensuring member 80 is at the main locking position, force is not applied to the first locking holding portion 61 in the removal direction from the second locking holding portion 62. The fitting connector, thus, can firmly disable unintentional operation of the locking release function in the holding structure 60 when the ensuring member 80 is at the main locking position.

Furthermore, in the fitting connector, an amount of relative movement of the ensuring member 80 between the main locking position and the temporary locking position may only be equivalent to a size that allows the release operation force receiving portion 65 to be present on the trajectory of the fulcrum portion 76 according to the push operation on the locking release operation portion 72 when the ensuring member 80 is at the main locking position and the release operation force receiving portion 85 to be off from the trajectory of the fulcrum portion 76 when the ensuring member 80 is at the temporary locking position. In other words, an amount of relative movement between the main locking position and the temporary locking position of a conventional ensuring member is enough for the relative movement amount. The fitting connector, thus, can prevent an increase in relative movement amount between the main locking position and the temporary locking position while the ensuring member 80 has a function of fulcrum necessary for the locking release operation of the holding structure 60, thereby making it possible to prevent an increase in its size.

Furthermore, the fitting connector has a simple structure in which the ensuring member 80 has a function of fulcrum necessary for the locking release operation of the holding structure 60. This structure can not only reduce a degree of freedom in design of the holding structure 60 and the ensuring member 80 but also increase a degree of freedom in design of the holding structure 60 and the ensuring member 80 by causing the operation portion 82 not to enter the space between the locking release operation portion 72 and the sub outer wall surface 20Ab when the ensuring member 80 is at the main locking position as described above.

As described above, the fitting connector in the embodiment can disable unintentional operation of the locking release function in the holding structure 60 when the ensuring member 80 is at the main locking position. The fitting connector can operate the locking release function in the holding structure 60 only by moving the ensuring member 80 to the temporary locking position. The fitting connector in the embodiment can enhance operability when the locking release function of the holding structure 60 is operated.

In the fitting connector according to the embodiment, the release operation force receiving portion is absent on a trajectory of the fulcrum portion according to the push operation on the locking release operation portion when the ensuring member is at the main locking position. In the fitting connector, even when the locking release operation portion is operated by being pushed when the ensuring member is at the main locking position, a fulcrum is not formed that is necessary for locking release operation between the first locking holding portion and the second locking holding portion in the holding structure because the fulcrum portion and the release operation force receiving portion are not in contact with each other. In the fitting connector, even when the locking release operation portion is operated by being pushed when the ensuring member is at the main locking position, the lockable state or the locked state between the first locking holding portion and the second locking holding portion is not released. The fitting connector according to the embodiment, thus, can disable unintentional operation of the locking release function in the holding structure when the ensuring member is at the main locking position.

Although the invention has been described with respect to specific embodiments for a complete and clear disclosure, the appended claims are not to be thus limited but are to be construed as embodying all modifications and alternative constructions that may occur to one skilled in the art that fairly fail within the basic teaching herein set forth.

What is claimed is:

1. A fitting electrical connector, comprising:

a first connector that includes an outer housing, a terminal and a housing positioned in the outer housing and holding the terminal;

a second connector that includes a counterpart terminal and a counterpart housing holding the counterpart terminal, and electrically connects the terminal and the counterpart terminal when a mutual fitted state according to insertion fitting between the housing and the counterpart housing is a completely fitted state;

a holding structure that includes a first locking holding portion provided to the outer housing and a second locking holding portion provided to the counterpart housing, causes the first locking holding portion and the second locking holding portion to be in a lockable state in respective connector removal directions when the fitted state is the completely fitted state, and holds the fitted state in the completely fitted state; and an ensuring member that is assembled to the outer housing to be capable of relatively moving between a main locking position at which the ensuring member restricts a movement of the first locking holding portion in a removal direction with respect to the second locking holding portion when the fitted state is the completely fitted state and a temporary locking position at which the ensuring member does not restrict the movement of the first locking holding portion in the removal direction with respect to the second locking holding portion when the fitted state is the completely fitted state, wherein the outer housing includes a locking holder including the first locking holding portion provided at one end of the outer housing in a connector insertion and removal direction, a locking release operation portion provided at the other end of the outer housing in the connector insertion and removal direction, a cantilever locking arm portion that is provided with the first locking holding portion at a free end of the cantilever locking arm portion and disposed between the first locking holding portion and the locking release operation portion, and a fulcrum portion that is disposed between the first locking holding portion and the locking release operation portion and applies force on the first locking holding portion serving as a point of load in the removal direction from the second locking holding portion with a contact point with a release operation force receiving portion as a fulcrum when the locking release operation portion serving as a point of effect is operated by being pushed, and the release operation force receiving portion is provided to the ensuring member and disposed at such a position that the release operation force receiving portion is not in contact with the fulcrum portion when the locking release operation portion is operated by being pushed while the ensuring member is at the main locking position, and the release operation force receiving portion is in contact with the fulcrum portion when the locking release operation portion is operated by being pushed while the ensuring member is at the temporary locking position.

2. The fitting electrical connector according to claim 1, wherein the outer housing has a space that a portion on the locking release operation portion side of the first locking holding portion of the locking holder enters when the locking release operation portion is operated by being pushed while the ensuring member is at the main locking position.

3. The fitting electrical connector according to claim 1, wherein the locking holder includes a locking release arm portion that couples the first locking holding portion and the locking release operation portion, and the fulcrum portion is provided to the locking release arm portion.

4. The fitting electrical connector according to claim 2, wherein the locking holder includes a locking release arm portion that couples the first locking holding portion and the locking release operation portion, and the fulcrum portion is provided to the locking release arm portion.

5. The fitting electrical connector according to claim 1, wherein the ensuring member includes a position restriction portion that locks a side adjacent to the first locking holding portion of the locking holder when the ensuring member is at the main locking position to restrict the movement of the first locking holding portion in the removal direction with respect to the second locking holding portion, an operation portion that is operated when the ensuring member is relatively moved with respect to the outer housing or housing, and a cantilever position restriction arm portion that is provided to the position restriction portion at a free end of the cantilever position restriction arm portion and disposed between the position restriction portion and the operation portion, and the release operation force receiving portion is provided to the position restriction arm portion.

6. The fitting electrical connector according to claim 2, wherein the ensuring member includes a position restriction portion that locks a side adjacent to the first locking holding portion of the locking holder when the ensuring member is at the main locking position to restrict the movement of the first locking holding portion in the removal direction with respect to the second locking holding portion, an operation portion that is operated when the ensuring member is relatively moved with respect to the outer housing or housing, and a cantilever position restriction arm portion that is provided to the position restriction portion at a free end of the cantilever position restriction arm portion and disposed between the position restriction portion and the operation portion, and the release operation force receiving portion is provided to the position restriction arm portion.

7. The fitting electrical connector according to claim 3, wherein the ensuring member includes a position restriction portion that locks a side adjacent to the first locking holding portion of the locking holder when the ensuring member is at the main locking position to restrict the movement of the first locking holding portion in the removal direction with respect to the second locking holding portion, an operation portion that is operated when the ensuring member is relatively moved with respect to the outer housing or housing, and a cantilever position restriction arm portion that is provided to the position restriction portion at a free end of the cantilever position restriction arm portion and disposed between the position restriction portion and the operation portion, and the release operation force receiving portion is provided to the position restriction arm portion.

8. The fitting electrical connector according to claim 4, wherein the ensuring member includes a position restriction portion that locks a side adjacent to the first locking holding portion of the locking holder when the ensuring member is at the main locking position to restrict the movement of the first locking holding portion in the removal direction with respect to the second locking holding portion, an operation portion that is operated when the ensuring member is relatively moved with respect to the outer housing or housing, and a cantilever position restriction arm portion that is provided to the position restriction portion at a free end of the cantilever position restriction arm portion and disposed between the position restriction portion and the operation portion, and the release operation force receiving portion is provided to the position restriction arm portion.

9. The fitting electrical connector according to claim 1, wherein the ensuring member enters the locking release operation portion side of the fulcrum portion of the locking holder in a direction in which the locking release operation portion is operated by being pushed when the ensuring member is at the main locking position, and locks the locking release operation portion side of the fulcrum portion of the locking holder when the locking release operation portion is operated by being pushed.

10. The fitting electrical connector according to claim 2, wherein the ensuring member enters the locking release operation portion side of the fulcrum portion of the locking holder in a direction in which the locking release operation portion is operated by being pushed when the ensuring member is at the main locking position, and locks the locking release operation portion side of the fulcrum portion of the locking holder when the locking release operation portion is operated by being pushed.

11. The fitting electrical connector according to claim 3, wherein the ensuring member enters the locking release operation portion side of the fulcrum portion of the locking holder in a direction in which the locking release operation portion is operated by being pushed when the ensuring member is at the main locking position, and locks the locking release operation portion side of the fulcrum portion of the locking holder when the locking release operation portion is operated by being pushed.

12. The fitting electrical connector according to claim 4, wherein the ensuring member enters the locking release operation portion side of the fulcrum portion of the locking holder in a direction in which the locking release operation portion is operated by being pushed when the ensuring member is at the main locking position, and locks the locking release operation portion side of the fulcrum portion of the locking holder when the locking release operation portion is operated by being pushed.

13. The fitting electrical connector according to claim 5, wherein the ensuring member enters the locking release operation portion side of the fulcrum portion of the locking holder in a direction in which the locking release operation portion is operated by being pushed when the ensuring member is at the main locking position, and locks the locking release operation portion side of the fulcrum portion of the locking holder when the locking release operation portion is operated by being pushed.

14. The fitting electrical connector according to claim 6, wherein the ensuring member enters the locking release operation portion side of the fulcrum portion of the locking holder in a direction in which the locking release operation portion is operated by being pushed when the ensuring member is at the main locking position, and locks the locking release operation portion side of the fulcrum portion of the locking holder when the locking release operation portion is operated by being pushed.

15. The fitting electrical connector according to claim 7, wherein the ensuring member enters the locking release operation portion side of the fulcrum portion of the locking holder in a direction in which the locking release operation portion is operated by being pushed when the ensuring member is at the main locking position, and locks the locking release operation portion side of the fulcrum portion of the locking holder when the locking release operation portion is operated by being pushed.

16. The fitting electrical connector according to claim 8, wherein the ensuring member enters the locking release operation portion side of the fulcrum portion of the locking holder in a direction in which the locking release operation portion is operated by being pushed when the ensuring member is at the main locking position, and locks the locking release operation portion side of the fulcrum portion of the locking holder when the locking release operation portion is operated by being pushed.

* * * * *